US006435667B1

(12) United States Patent
Silverbrook

(10) Patent No.: US 6,435,667 B1
(45) Date of Patent: Aug. 20, 2002

(54) OPPOSED EJECTION PORTS AND INK INLETS IN AN INK JET PRINTHEAD CHIP

(75) Inventor: Kia Silverbrook, Balmain (AU)

(73) Assignee: Silverbrook Research Pty Ltd., Balmain (AU)

( * ) Notice: Subject to any disclaimer, the term of this patent is extended or adjusted under 35 U.S.C. 154(b) by 0 days.

(21) Appl. No.: 09/998,192

(22) Filed: Dec. 3, 2001

Related U.S. Application Data

(63) Continuation-in-part of application No. 09/112,764, filed on Jul. 10, 1998, now Pat. No. 6,336,710.

(30) Foreign Application Priority Data

Dec. 12, 1997 (AU) ..... PP0890

(51) Int. Cl.[7] ..... B41J 2/015; B41J 2/135; B41J 2/14; B41J 2/04

(52) U.S. Cl. ..... 347/54; 347/20; 347/44; 347/47

(58) Field of Search ..... 347/20, 44, 47, 347/54, 86

(56) References Cited

U.S. PATENT DOCUMENTS 5,812,159 A * 9/1998 Anagnostopoulos et al. .. 347/55

FOREIGN PATENT DOCUMENTS

| | | | | |
|---|---|---|---|---|
| EP | 0416540 A2 | * | 3/1991 | ..... 347/68 |
| JP | 403292147 A | * | 12/1991 | ..... 347/68 |
| JP | 404001051 A | | 1/1992 | |

* cited by examiner

*Primary Examiner*—John Barlow
*Assistant Examiner*—An H. Do

(57) ABSTRACT

A printhead chip for an ink jet printhead includes an elongate substrate. A plurality of nozzle arrangements is positioned along a length of the substrate. An ink inlet channel is in fluid communication with a respective nozzle arrangement. Each nozzle arrangement includes a nozzle chamber and an ink ejection port. An ink ejection member is positioned within the nozzle chamber and is displaceable towards and away from the ink ejection port to eject ink from the nozzle chamber. The nozzle chamber is generally elongate and has a distal end and an opposed proximal end. The inlet channel of the nozzle chamber is positioned adjacent the proximal end and the ink ejection port is positioned adjacent the distal end. An actuator is mounted on the substrate and is electrically connected to drive circuitry positioned on the substrate to drive the actuator and to the ink ejection member to displace the ink ejection member towards and away from the ink ejection port. The nozzle chamber is dimensioned so that a fluid flow path defined between the ink ejection port and the ink inlet channel is configured to retard ink flow between the ink ejection port and the ink inlet channel during ejection of ink from the ink ejection port.

22 Claims, 7 Drawing Sheets

OPPOSED EJECTION PORTS AND INK INLETS IN AN INK JET PRINTHEAD CHIP

RELATED AND REFERENCED PATENT APPLICATIONS

This application is a continuation-in-part application of U.S. patent application No. 09/112,764 now U.S. Pat. No. 6,336,710. The following U.S. patent Nos. and U.S. application Nos. are herby incorporated by reference: 6,227,652 6,213,588 6,213,589 6,231,163 6,247,795 6,244,691 6,257,704 6,220,694 6,257,705 6,247,794 6,234,610 6,247,793 6,264,306 6,241,342 6,247,792 6,264,307 6,254,220 6,234,611 6,302,528 6,283,582 6,239,821 6,338,547 6,247,796 6,362,843 6,393,653 6,312,107 6,227,653 6,324,609 6,238,040 6,188,415 6,227,654 6,209,989 6,247,791 6,336,710 6,217,153 6,243,113 6,283,581 6,247,790 6,260,953 6,267,469 6,273,544 6,309,048 6,378,989 6,362,868 09/425,420 09/422,893 09/693,703 09/693,706 09/693,313 09/693,279 09/693,727 09/693,708 09/575,141 09/112,778 09/113,099 09/113,122 09/112,793 09/112,767 09/425,194 09/425,193 09/422,892.

STATEMENT REGARDING FEDERALLY SPONSORED RESEARCH OR DEVELOPMENT

Not Applicable

FIELD OF THE INVENTION

This invention relates to an ink jet printhead chip. More particularly, this invention relates to positioning of ink ejection ports and ink inlets in an ink jet printhead chip.

BACKGROUND OF THE INVENTION

As set out in the above referenced applications/patents, the Applicant has spent a substantial amount of time and effort in developing printheads that incorporate micro electromechanical system (MEMS)—based components to achieve the ejection of ink necessary for printing.

As a result of the Applicant's research and development, the Applicant has been able to develop printheads having one or more printhead chips that together incorporate up to 84,000 nozzle arrangements. The Applicant has also developed suitable processor technology that is capable of controlling operation of such printheads. In particular, the processor technology and the printheads are capable of cooperating to generate resolutions of 1600 dpi and higher in some cases. Examples of suitable processor technology are provided in the above referenced patent applications/patents.

The Applicant has overcome substantial difficulties in achieving the necessary ink flow and ink drop separation within the ink jet printheads. A number of printhead chips that the Applicant has developed incorporate nozzle arrangements that each have a nozzle chamber with an ink ejection member positioned in the nozzle chamber. The ink ejection member is then displaceable within the nozzle chamber to eject ink from the nozzle chamber.

An example of such a printhead chip has a nozzle arrangement that is shown schematically with reference numeral 1 in FIG. 1. The nozzle arrangement 1 is positioned on a substrate 2. Nozzle chamber walls 4A and a roof 4B define a nozzle chamber 5 and an ink ejection port 3 in the roof 4B. An ink inlet channel 6 is defined in the substrate 2 and opens into the nozzle chamber 5. The nozzle arrangement 1 includes an ink ejection member 7 that is interposed between the ink ejection port 3 and the ink inlet channel 6. In this embodiment, ink flow is at a premium since the ink inlet channel 6 is as close to the ink ejection port 3 as possible.

Another example of a printhead chip that the Applicant has developed has a number of nozzle arrangements such as the nozzle arrangement 8 indicated schematically in FIG. 2. With reference to FIG. 1, like reference numerals refer to like parts, unless otherwise specified.

Instead of the moving ink ejection member 7, the nozzle chamber walls 4A and the roof 4B of the nozzle arrangement 8 are movable. A static member 9 is positioned in the nozzle chamber 5 so that, when the walls 4A and roof 4B are moved relative to the substrate 2, ink is ejected from the ink ejection port 3.

A particular difficulty with this form of embodiment is associated with achieving the necessary ink ejection pressure within the nozzle chamber 5. A major cause of an undesirable drop in pressure is the flow of ink into the ink inlet channel 6 during displacement of the ink ejection member 7 or the nozzle chamber walls 4A and roof 4B to eject the ink.

In order to address this problem, the Applicant has conceived the present invention.

SUMMARY OF THE INVENTION

According to a first aspect of the invention, there is provided a printhead chip for an ink jet printhead, the printhead chip comprising an elongate substrate; and a plurality of nozzle arrangements that are positioned along a length of the substrate, the substrate defining a plurality of ink inlet channels, each ink inlet channel being in fluid communication with a respective nozzle arrangement, each nozzle arrangement comprising nozzle chamber walls and a roof that define a nozzle chamber, the roof defining an ink ejection port;

an ink ejection member that is positioned within the nozzle chamber and is displaceable towards and away from the ink ejection port to eject ink from the nozzle chamber, the nozzle chamber walls and the roof being configured so that the nozzle chamber is generally elongate and has a distal end and an opposed proximal end, the inlet channel of the nozzle chamber being positioned adjacent the proximal end and the ink ejection port being positioned adjacent the distal end; and an actuator that is mounted on the substrate, the actuator being electrically connected to drive circuitry positioned on the substrate to drive the actuator and the actuator being connected to the ink ejection member to displace the ink ejection member towards and away from the ink ejection port, the nozzle chamber walls and roof being dimensioned so that a fluid flow path defined between the ink ejection port and the ink inlet channel is configured to retard ink flow between the ink ejection port and the ink inlet channel during ejection of ink from the ink ejection port.

According to a second aspect of the invention, there is provided a printhead chip for an ink jet printhead, the printhead chip comprising an elongate substrate; and a plurality of nozzle arrangements that are positioned along a length of the substrate, the substrate defining a plurality of ink inlet channels, each ink inlet channel being in fluid communication with a respective nozzle arrangement, each nozzle arrangement comprising.

a nozzle chamber structure that at least partially defines a nozzle chamber, the nozzle chamber structure having a roof that defines an ink ejection port, the nozzle chamber structure being configured so that the nozzle chamber is generally a elongate and has a distal end and an opposed proximal end, the ink inlet channel of the nozzle arrangement being positioned adjacent the proximal end and the ink ejection port being positioned adjacent the distal end;

an actuator that is mounted on the substrate, the actuator being electrically connected to drive circuitry positioned on the substrate to drive the actuator and the actuator being connected to the nozzle chamber structure at the proximal end of the nozzle chamber so that the actuator can displace the nozzle chamber structure towards and away from the substrate; and a static member that is mounted on the substrate intermediate the ink ejection port and the substrate so that displacement of the structure towards and away from the substrate results in the ejection of a drop of ink from the ink ejection port, the structure being dimensioned so that a fluid flow path defined between the ink ejection port and the ink inlet channel is configured to retard a flow of ink from the ink ejection port to the ink inlet channel when the structure is displaced towards the substrate.

The invention is now described, by way of example, with reference to the accompanying drawings. The following description is not intended to limit the broad scope of the above summary.

DETAILED DESCRIPTION OF THE INVENTION

Figure 1:
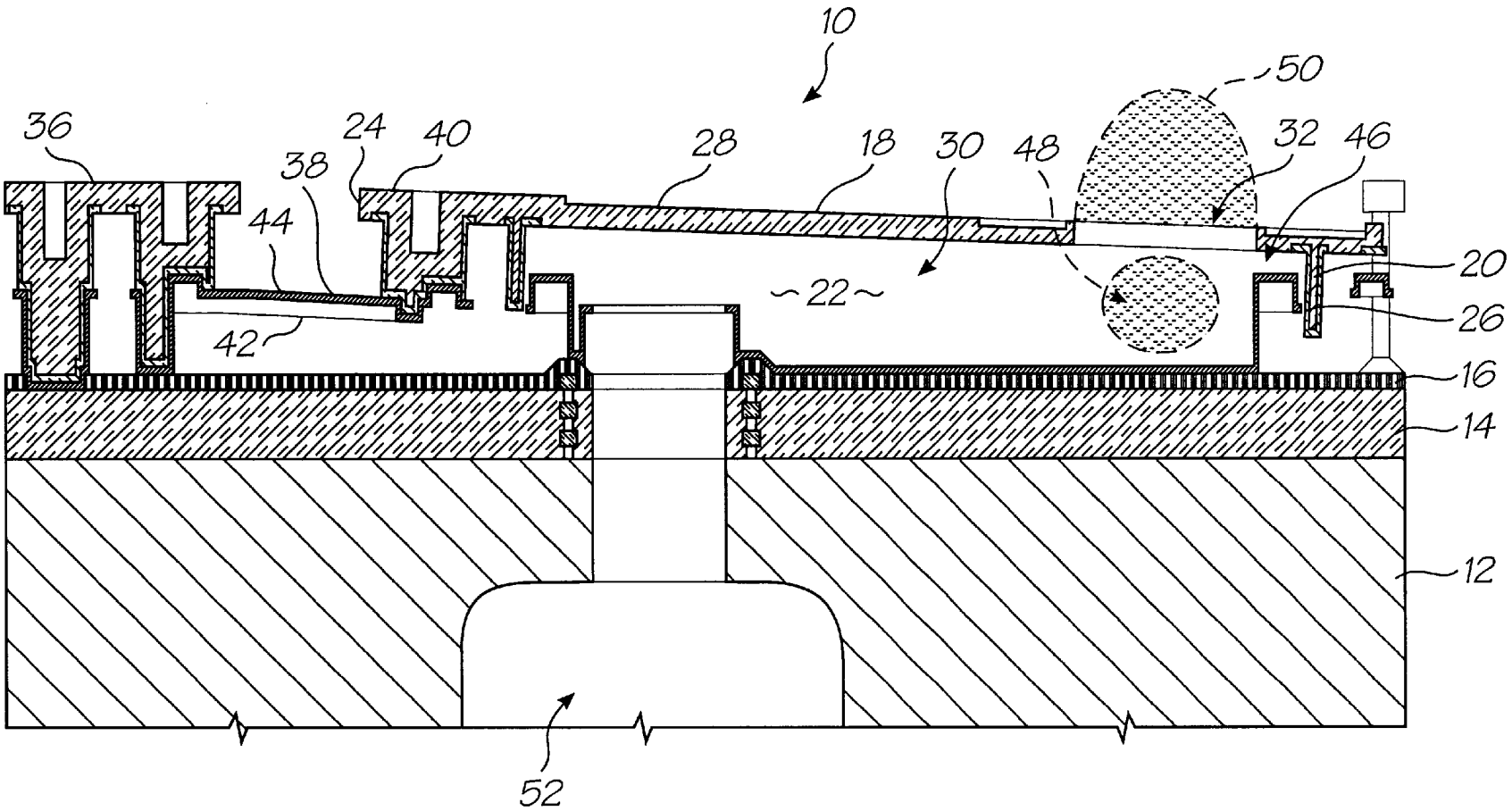
FIG. 1 shows a schematic side sectioned view of a nozzle arrangement of an example of a printhead chip that the Applicant has developed.
Figure 2:
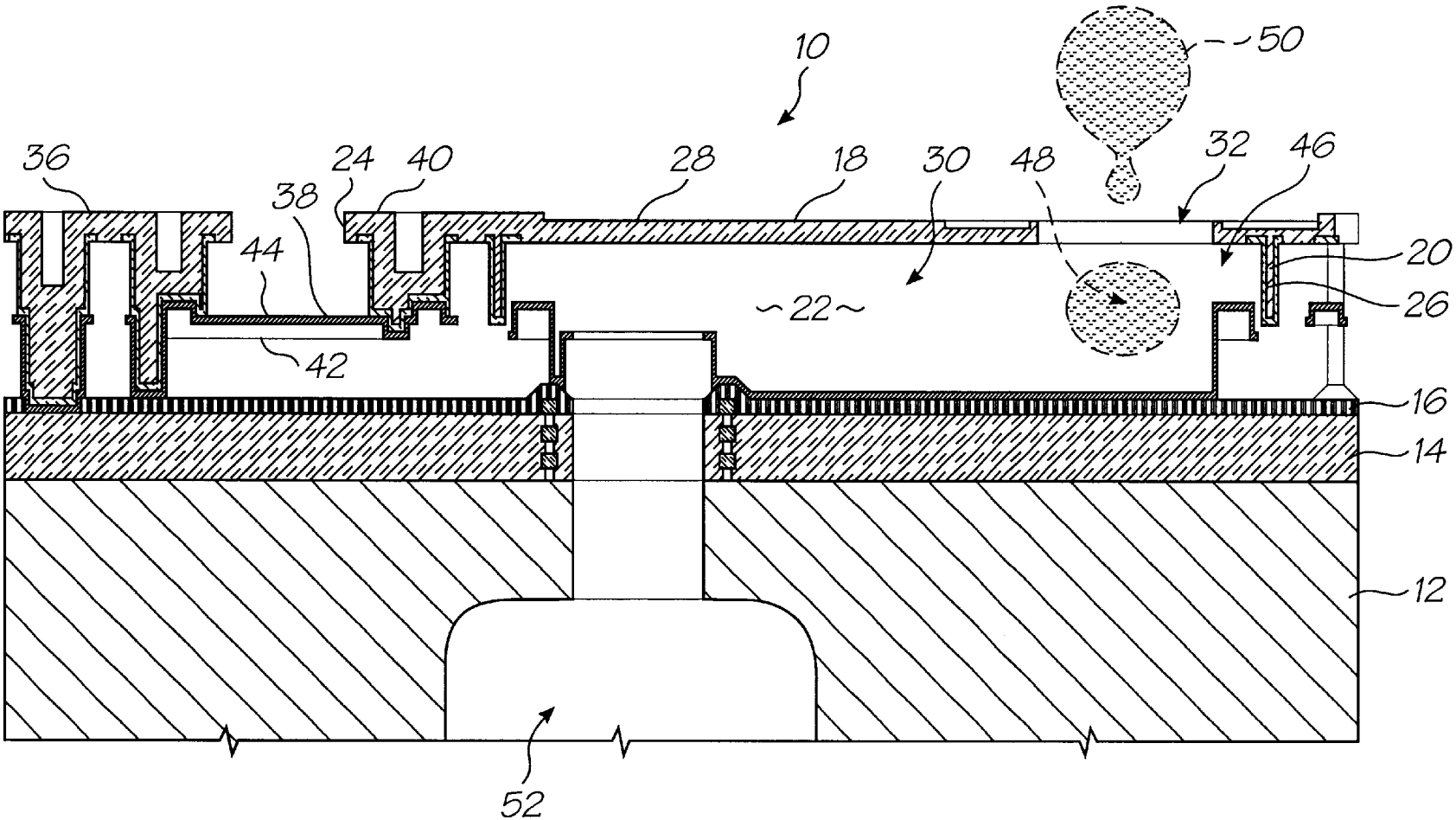
FIG. 2 shows a schematic side sectioned view of a nozzle arrangement of another example of a printhead chip that the Applicant has developed.
Figure 3:
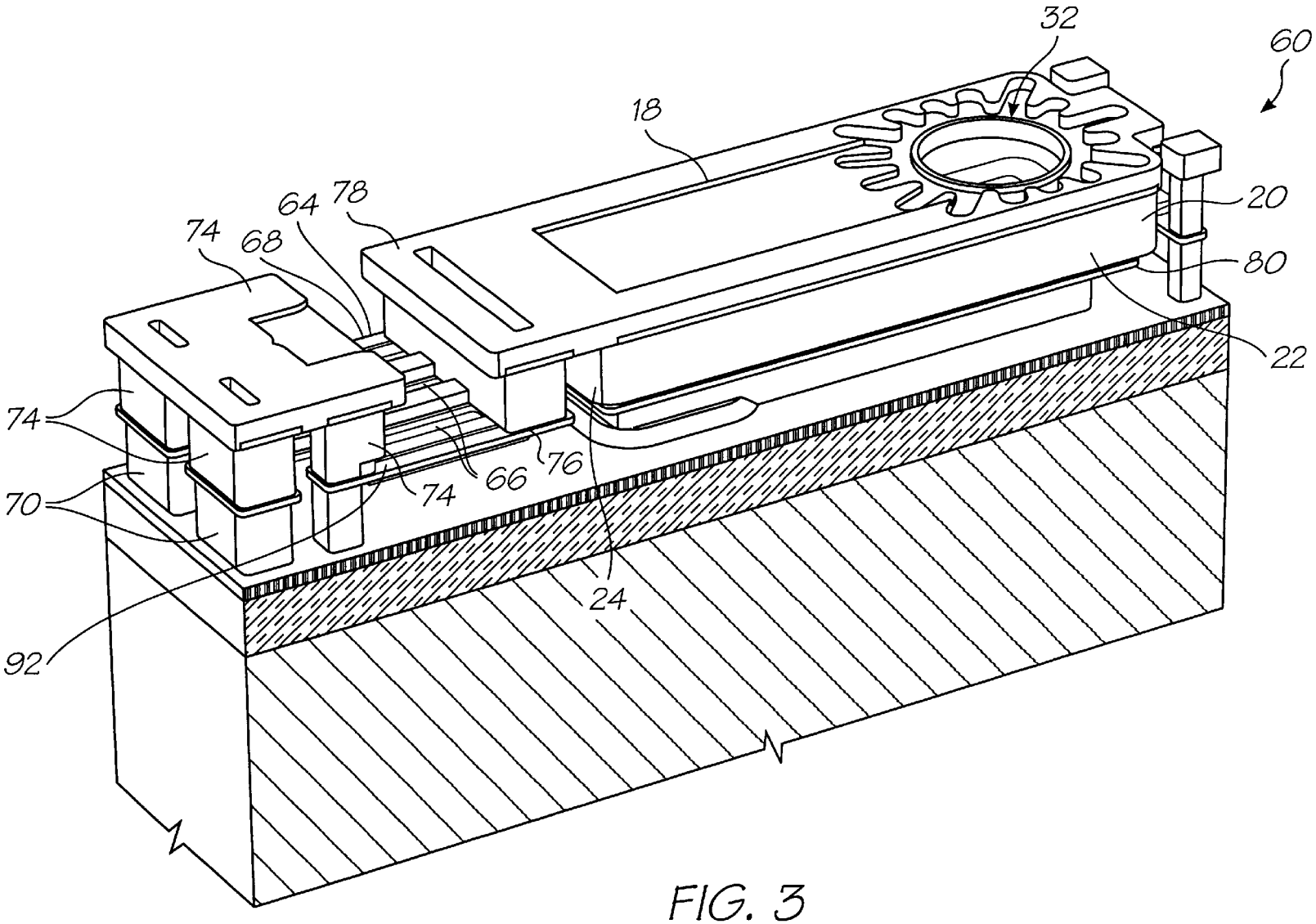
FIG. 3 shows a schematic side sectioned view of a nozzle arrangement of a first embodiment of a printhead chip, in accordance with the invention, with an ink ejection member in an operative condition.
Figure 4:
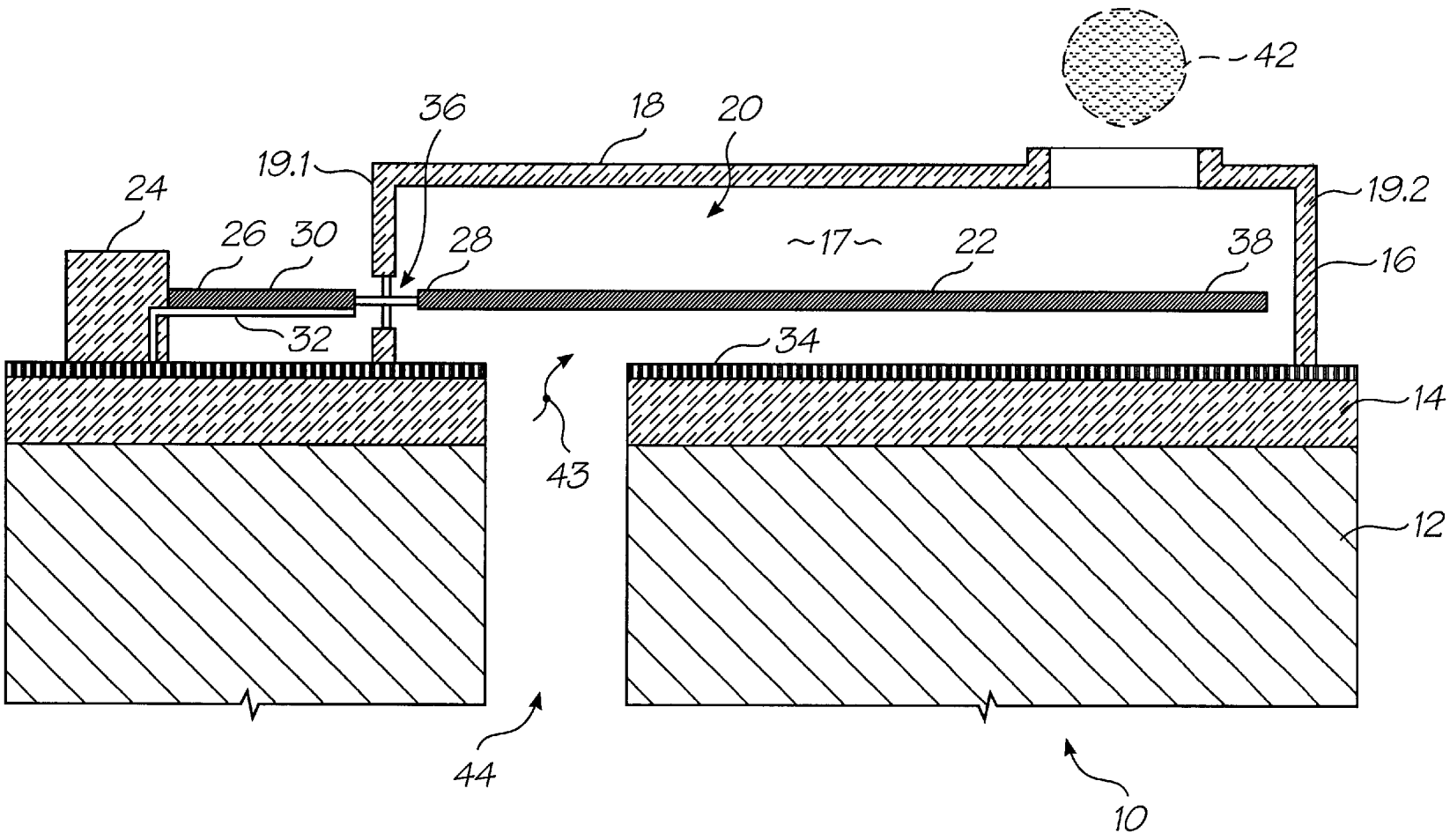
FIG. 4 shows a schematic side sectioned view of the nozzle arrangement of FIG. 3 with the ink ejection member in a quiescent condition.

In FIGS. 3 and 4, reference numeral 10 generally indicates a nozzle arrangement of a first embodiment of a printhead chip, in accordance with the invention, for an ink jet printhead.

The nozzle arrangement 10 is one of a plurality of such nozzle arrangements formed on a silicon wafer substrate 12 to define the printhead chip of the invention. As set out in the background of this specification, a single printhead can contain up to 84,000 such nozzle arrangements. For the purposes of clarity and ease of description, only one nozzle arrangement is described. It is to be appreciated that a person of ordinary skill in the field can readily obtain the printhead chip by simply replicating the nozzle arrangement 10 on the wafer substrate 12.

The printhead chip is the product of an integrated circuit fabrication technique. In particular, each nozzle arrangement 10 is the product of a MEMS—based fabrication technique. As is known, such a fabrication technique involves the deposition of functional layers and sacrificial layers of integrated circuit materials. The functional layers are etched to define various moving components and the sacrificial layers are etched away to release the components. As is known, such fabrication techniques generally involve the replication of a large number of similar components on a single wafer that is subsequently diced to separate the various components from each other. This reinforces the submission that a person of ordinary skill in the field can readily obtain the printhead chip of this invention by replicating the nozzle arrangement 10.

An electrical drive circuitry layer 14 is positioned on the silicon wafer substrate 12. The electrical drive circuitry layer 14 includes CMOS drive circuitry. The particular configuration of the CMOS drive circuitry is not important to this description and has therefore been shown schematically in the drawings. Suffice to say that it is connected to a suitable microprocessor and provides electrical current to the nozzle arrangement 10 upon receipt of an enabling signal from said suitable microprocessor. An example of a suitable microprocessor is described in the above referenced patents/patent applications. It follows that this level of detail will not be set out in this specification.

An ink passivation layer 34 is positioned on the drive circuitry layer 14. The ink passivation layer 34 can be of any suitable material, such as silicon nitride.

The nozzle arrangement 10 includes nozzle chamber walls 16 in the form of a pair of opposed sidewalls 17, a proximal end wall 19.1 and a distal end wall 19.2. A roof 18 is positioned on the nozzle chamber walls 16 so that the nozzle chamber walls 16 and the roof 18 define a nozzle chamber 20. The roof 18 defines an ink ejection port 21 adjacent the distal end wall 19.2.

The nozzle chamber walls 16 and the roof 18 are of a suitable structural integrated circuit material such as silicon nitride or any other integrated circuit material with suitable structural characteristics.

The walls 16 are dimensioned so that a length of the nozzle chamber 20 is between approximately 4 and 10 times a height of the nozzle chamber 20. More particularly, the length of the nozzle chamber 20 is approximately seven times a height of the nozzle chamber 20. It is to be understood that the relationship between the length of the nozzle chamber 20 and the height of the nozzle chamber 20 can vary substantially while still being effective for the purposes of this invention. This relationship is discussed further below.

The nozzle arrangement 10 includes an anchor formation 24 that is positioned on the substrate 12 adjacent the proximal end wall 19.1. A thermal bend actuator 26 is mounted on the anchor formation 24 and extends towards the proximal end wall 19.1.

The nozzle arrangement 10 includes an ink displacement member in the form of a paddle 22 that is positioned in the nozzle chamber 20. The paddle 22 extends from the proximal end wall 19.1 towards a distal end wall 19.2.

A proximal end 28 of the paddle 22 is attached to the thermal bend actuator 26. Thus, bending of the actuator 26 results in angular displacement of the paddle 22. The proximal end 28 of the paddle 22 is attached to the thermal bend actuator 26 through an opening 36 defined in the proximal wall 19.2.

The actuator 26 has a support member 30 that is fast with, and extends from, the anchor formation 24 spaced from the substrate 12. A heating member 32 is fast with the support member 30. The heating member 32 extends at least partially along a length of the support member 30. The heating member 32 is configured to define a resistive heating circuit. Many such heating circuits are described in the above patents and patent applications. Thus, the heating circuit defined by the member 32 is not described in any detail in this specification. However, it can simply be a length of conductive material connected at each end to an electrical contact defined by the CMOS circuitry. It follows that when the CMOS circuitry generates a suitable current through the heating member 32, the heating member 32 heats up to an extent that is a function of a configuration of the heating circuit and the current generated by the CMOS circuitry.

The heating member 32 is also of a material that has a coefficient of thermal expansion that is such that the heating member 32 is capable of performing work when heated and subsequently cooled. The material can be one of many that are presently used in integrated circuit fabrication. Examples are titanium aluminum nitride, gold, copper and the like. The heating member 32 is oriented intermediate the support member 30 and the substrate 12.

The support member 30 is of a material that does not expand to any significant extent when heated. It is thus to be appreciated that when the heating member 32 expands upon heating, the support member 30, together with the heating member 32, bends away from the substrate 12. This causes the paddle 22 to be angularly displaced towards the roof 18. This movement of the paddle 22 is indicated in FIG. 3. It is clear that such movement is amplified at an end portion 38 of the paddle 22 as a result of the length of the paddle 22. As set out above, the ink ejection port 21 is positioned adjacent the distal end wall 19.2. It follows that the end portion 38 of the paddle 22 is positioned in general alignment with the ink ejection port 21. It is to be understood that, on the microscopic scale of this invention, the movement of the thermal actuator 26 is different to what would be expected on a macroscopic scale. As set out above, the nozzle arrangement 10 is manufactured on a MEMS scale. It follows that the nozzle arrangement 10 is microscopic. In particular, the nozzle arrangement 10 has a length dimension of between 80 and 90 microns and a width dimension of 20 to 30 microns. On this scale, the Applicant has found that movement of the thermal actuator 26 is fast enough to generate the required ink ejection pressure within the nozzle chamber 20. Furthermore, a force generated by expansion of the heating member 32 is sufficiently high to drive relatively large ink ejection components. However, Applicant has also determined that it would be desirable to amplify the extent of movement of an ink-ejecting component in order to achieve positive ejection of ink and good separation of an ink drop. In this invention, this is achieved by providing the paddle 22 that is a number of times longer than the thermal bend actuator 26.

The fact that the extent of movement of the paddle 22 at the end portion 38 is greatest results in the generation of a region of relatively high pressure between the end portion 38 and the ink ejection port 21. Thus, a drop of ink indicated at 42 is formed outside of the ink ejection port 21 with a momentum directed away from the ink ejection port 21.

When the current within the heating member 32 is discontinued, the heating member 32 cools and subsequently contracts. This causes the paddle 22 to move into the position shown in FIG. 4. This results in a drop in pressure in the region 40. This drop in pressure together with the momentum already imparted to the ink drop 42 causes the required separation of the ink drop 42. Once the drop 42 has separated, ink moves, in the direction of an arrow 43, into the nozzle chamber 20 to refill the nozzle chamber 20.

The support member 30 can be of a material having a suitable Young's Modulus to assist movement of the paddle 22 into the position shown in FIG. 4. Thus, energy stored in the support member 30 when the support member 30 is bent by differential expansion of the heating member 32 and the support member 30 is released when the heating member 32 cools and contracts.

An ink inlet channel 44 is defined through the substrate 12, the drive circuitry layer 14 and the ink passivation layer 34. The ink inlet channel 44 is in fluid communication with an ink supply to refill the nozzle chamber 20 once the drop 42 has been ejected. The ink inlet channel 44 is positioned adjacent the proximal end wall 19.1. Thus, an ink flow path is defined between the ink inlet channel 44 and the ink ejection port 21, the ink flow path extending the length of the nozzle chamber 20.

A difficulty to overcome in achieving the required ink ejection pressure was identified by the Applicant as being backflow from the region 40 towards the ink inlet channel 44 along the ink flow path. In order to address this problem, a length of the nozzle chamber 20 is between 3 and 10 times a height of the nozzle chamber 20, as described above. Thus, while the paddle 22 is moving into the position shown in FIG. 3, viscous drag within the nozzle chamber 20 is effectively used to retard backflow of ink towards the ink inlet channel 44, since the ink inlet channel 44 and the region 40 are positioned at opposite ends of the nozzle chamber 20.

There is also a requirement that the nozzle chamber 20 be refilled with ink sufficiently rapidly so that a further ink drop can be ejected. It follows that, with such factors as ink viscosity and ink paddle geometry taken as constant, the optimal relationship between the length of the nozzle chamber 20 and the height of the nozzle chamber 20 is a function of the required ink ejection pressure and a required maximum refill time. It follows that, once such factors as ink viscosity and paddle geometry are known, it is possible to determine an optimum relationship between the nozzle chamber length and the nozzle chamber height.

Figure 5:
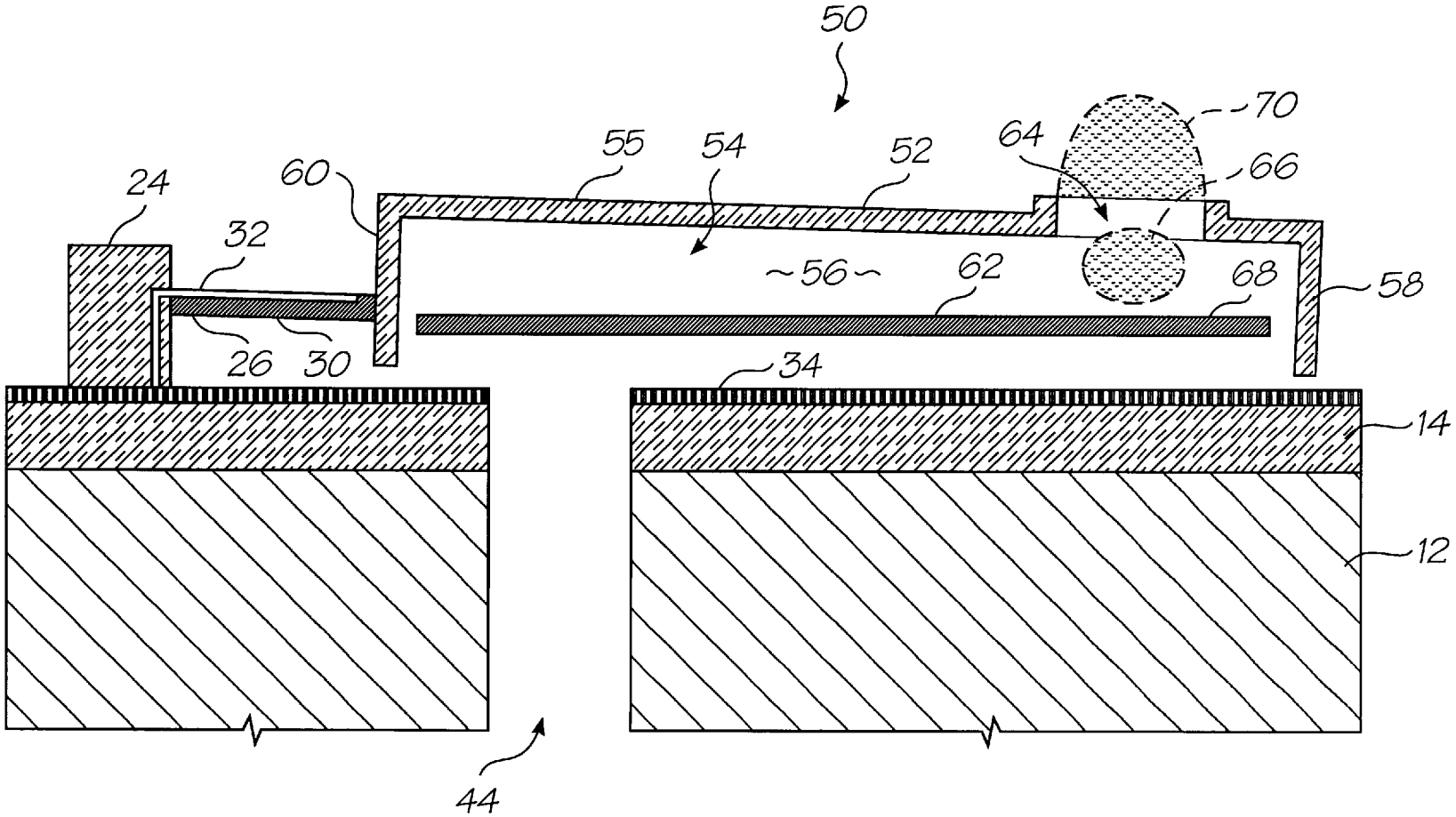
FIG. 5 shows a schematic side sectioned view of a nozzle arrangement of a second embodiment of a printhead chip, in accordance with the invention, in an operative condition.
Figure 6:
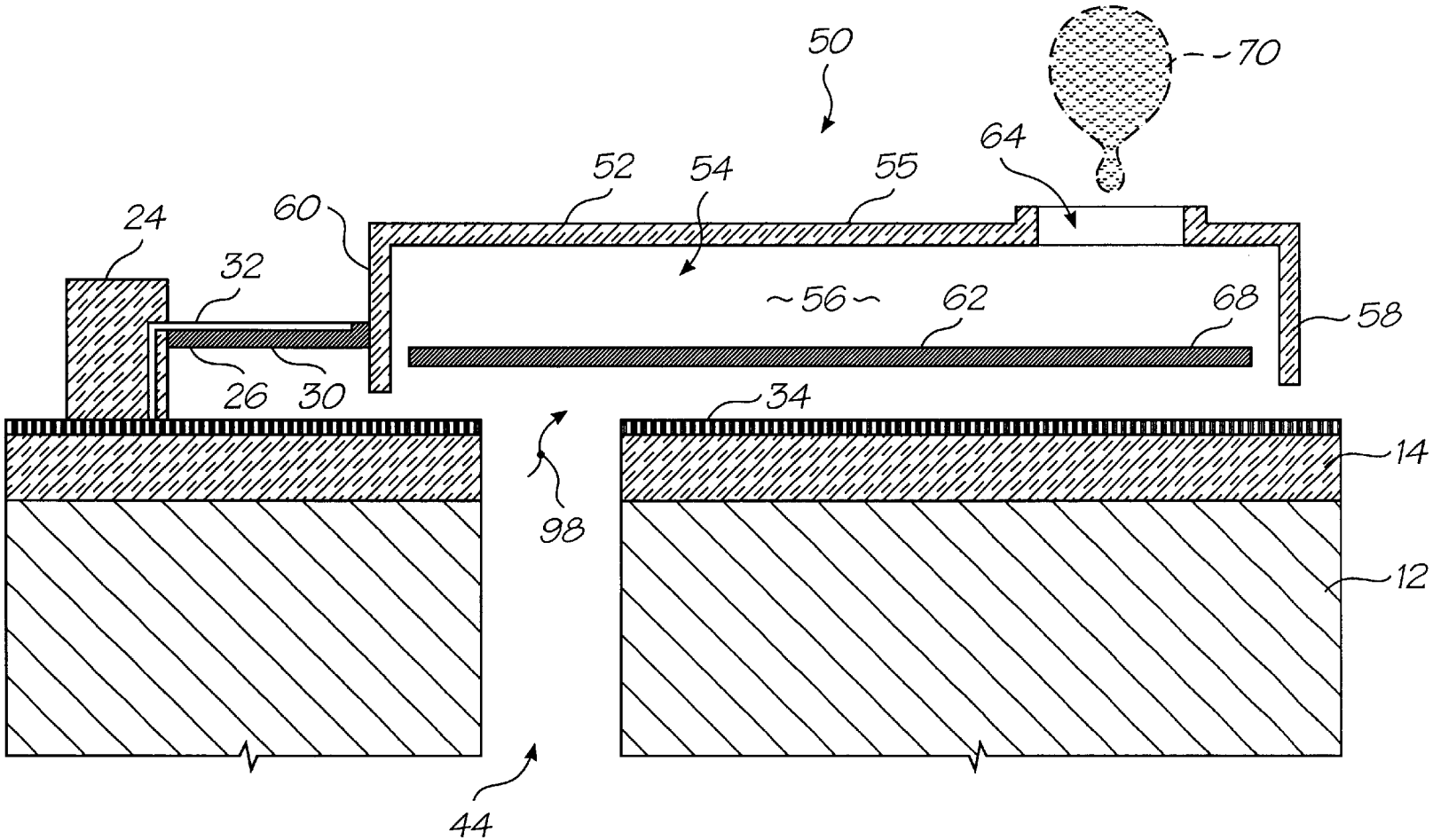
FIG. 6 shows a schematic side sectioned view of the nozzle arrangement of FIG. 5 in a quiescent condition.

In FIGS. 5 and 6, reference numeral 50 generally indicates a second embodiment of a nozzle arrangement of a printhead chip, in accordance with the invention. With reference to FIGS. 1 to 4, like reference numerals refer to like parts, unless otherwise specified.

Instead of the paddle 22, the nozzle arrangement 50 has a nozzle chamber structure 52 that defines a nozzle chamber 54. The structure 52 is angularly displaceable with respect to the substrate 12. The structure 52 has a roof 55. A pair of opposed sidewalls 56, a distal end wall 58 and a proximal end wall 60 depend from the roof 55.

The proximal end wall 60 is attached to the thermal bend actuator 26. Thus, the thermal bend actuator 26 serves to displace the structure 52 rather than the paddle 22 as in the nozzle arrangement 10. The nozzle arrangement 50 includes a static member in the form of a plate 62 that is positioned on the substrate 12 to be spaced from, and generally parallel to, the substrate 12. The static plate 62 is dimensioned to span a region intermediate the proximal and distal end walls 60, 58.

As with the nozzle arrangement 10, an ink ejection port 64 is defined in the roof 55. The ink ejection port 64 is positioned adjacent the distal end wall 58.

The thermal bend actuator 26 is configured so that, when a current from the CMOS circuitry passes through the heating member 32, the thermal bend actuator 26 bends towards the substrate 12, causing the structure 52 to be angularly displaced towards the substrate 12. Thus, the heating member 32 is positioned on the support member 30 so that the support member 30 is interposed between the heating member 32 and the substrate 12.

The nozzle chamber 54 and the nozzle chamber 20 of the nozzle arrangement 10 have similar dimensions. It follows that a greatest extent of movement of the structure 52 occurs at a distal end of the structure 52. Thus, a region 66 of high pressure is developed between a distal end portion 68 of the plate 62 and the ink ejection port 64. This results in the formation of a drop of ink, indicated at 70, outside of the ink ejection port 64, the drop 70 having a momentum directed away from the ink ejection port 64.

It will be appreciated that backflow is inhibited in the same way as it is inhibited in the nozzle arrangement 10.

When the heating member 32 cools, contraction of the heating member 32 causes the structure 52 to move into the position shown in FIG. 6. This results in a drop of pressure in the region 66. This drop in pressure, together with the momentum imparted to the drop 70, causes the drop 70 to separate. Once the drop 70 has separated, ink moves into the nozzle chamber 54 from the ink inlet channel 44 in the direction of an arrow 98 to refill the nozzle chamber 54.

Figure 7:
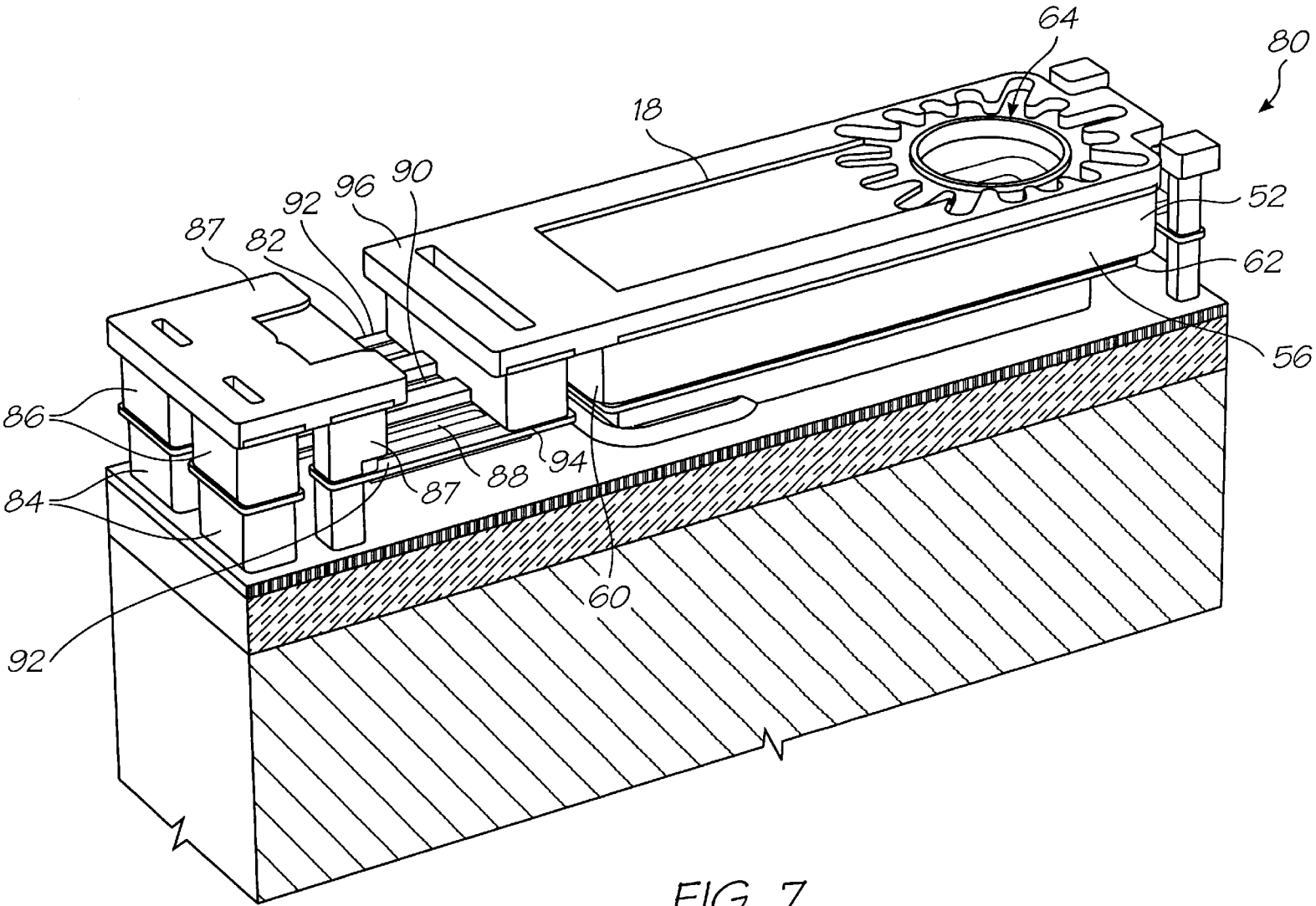
FIG. 7 shows a three dimensional view of a nozzle arrangement of a third embodiment of a printhead chip, in accordance with the invention.

In FIG. 7, reference numeral 80 generally indicates a nozzle arrangement of a third embodiment of a printhead chip, in accordance with the invention, for an ink jet printhead. With reference to FIGS. 1 to 6, like reference numerals refer to like parts, unless otherwise specified.

The nozzle arrangement 80 is, in principle, substantially the same as the nozzle arrangement 50. A primary distinguishing feature is the fact that the nozzle arrangement 80 includes a thermal bend actuator 82 that is of a different configuration to the thermal bend actuator 26.

The thermal bend actuator 82 has a heating member 88. The heating member 88 has a pair of inner active portions 90 interposed between a pair of outer passive portions 92. The inner active portions 90 are connected at proximal ends to the CMOS drive circuitry with a pair of respective active anchors 84. The outer passive portions 92 are connected at proximal ends to the ink passivation layer 34 with a pair of respective passive anchors 87. The active anchors 84 are connected to the CMOS drive circuitry in the drive circuitry layer 14 with vias 86.

The heating member 88 is of an electrically conductive material. Further, the active portions 90 are configured so that they can be resistively heated when an electrical current from the CMOS drive circuitry passes through the active portions 90. It will be appreciated that this resistive heating is to the substantial exclusion of the passive portions 92. The material of the heating member 88 is selected to have a coefficient of thermal expansion that is such that, when heated and cooled, the material can expand and contract to an extent sufficient to perform work. It follows that since the passive portions 92 are not heated, differential expansion of the heating member 88 occurs. The material of the heating member 88 can be selected from those used in integrated circuit fabrication in order to avoid contamination. An example of a suitable material is titanium aluminum nitride (TiAlNi).

Or As can be seen in FIG. 7, the active and passive anchors 84, 87 are arranged in a nested manner in order to save chip real estate.

The heating member 88 includes a bridge portion 94 that interconnects distal ends of the active and passive portions 90, 92.

The heating member 88 is shaped so that, on average, a volume defined by the passive portions 92 is closer to the substrate 12 than, on average, a volume defined by the active portions 90.

It follows that the differential expansion referred to above results in the heating member 88 bending towards the substrate 12. Upon cooling and subsequent contraction of the active portions 90, the heating member 88 returns to a starting position. The material selected for the heating member should also have a Young's Modulus that is such that energy, developed in the passive portions 92 when the heating member 88 is bent, is released to assist movement of the heating member 88 into the start condition. As with the nozzle arrangement 50, this facilitates separation of a drop of ink.

A connecting formation 96 is positioned on the bridge portion 94. The connecting formation 96, in this embodiment, forms part of the structure 52 so that the movement of the heating member 88 can be transferred to the structure 52.

The Applicant believes that this invention provides a means whereby undesirable backflow within a nozzle arrangement of a printhead chip can be inhibited during the build up of ink ejection pressure. Furthermore, this can be achieved without the necessity for introducing further components into the nozzle arrangement thereby avoiding excessive cost.

We claim:

1. A printhead chip for an ink jet printhead, the printhead chip comprising an elongate substrate; and a plurality of nozzle arrangements that are positioned along a length of the substrate, the substrate defining a plurality of ink inlet channels, each ink inlet channel being in fluid communication with a respective nozzle arrangement, each nozzle arrangement comprising nozzle chamber walls and a roof that define a nozzle chamber, the roof defining an ink ejection port;

an ink ejection member that is positioned within the nozzle chamber and is displaceable towards and away from the ink ejection port to eject ink from the nozzle chamber, the nozzle chamber walls and the roof being configured so that the nozzle chamber is generally elongate and has a distal end and an opposed proximal end, the ink inlet channel of the nozzle chamber being positioned adjacent the proximal end and the ink ejection port being positioned adjacent the distal end; and an actuator that is mounted on the substrate, the actuator being electrically connected to drive circuitry positioned on the substrate to drive the actuator and the actuator being connected to the ink ejection member to displace the ink ejection member towards and away from the ink ejection port, the nozzle chamber walls and roof being dimensioned so that a fluid flow path defined between the ink ejection port and the ink inlet channel is configured to retard ink flow between the ink ejection port and the ink inlet channel during ejection of ink from the ink ejection port.

2. A printhead chip as claimed in claim 1, which is the product of an integrated circuit fabrication technique.

3. A printhead chip as claimed in claim 2, in which CMOS drive circuitry is arranged on the substrate, each actuator being connected to the CMOS drive circuitry.

4. A printhead chip as claimed in claim 1, in which the nozzle chamber walls and the roof are dimensioned so that a length of the nozzle chamber is at least three times an average height of the nozzle chamber.

5. A printhead chip as claimed in claim 4, in which the ink ejection member is dimensioned to span a region between the ends of the nozzle chamber, the ink ejection member being connected to the actuator at the proximal end of the nozzle chamber.

6. A printhead chip as claimed in claim 5, in which the nozzle chamber walls are configured so that the nozzle chamber has a substantially rectangular plan profile, with a pair of opposed sidewalls, a proximal end wall and an opposed distal end wall.

7. A printhead chip as claimed in claim 6, in which a length of the nozzle chamber is between approximately four times and ten times a depth of the nozzle chamber.

8. A printhead chip as claimed in claim 6, in which the ink ejection member is generally planar with a profile that corresponds generally with that of the nozzle chamber, the ink ejection member having a distal end portion that is positioned adjacent the ink ejection port and an opposed proximal end portion that is attached to the actuator and is positioned adjacent the inlet channel, with the ink ejection member positioned intermediate the inlet channel and the ink ejection port.

9. A printhead chip as claimed in claim 8, in which the actuator is in the form of a thermal bend actuator having a fixed end that is fast with an anchor formation positioned on the substrate and a movable end that is attached to the proximal end portion of the ink ejection member, the thermal actuator being connected to the CMOS drive circuitry.

10. A printhead chip as claimed in claim 9, in which the thermal bend actuator includes an electrically conductive heating member that is connected to the CMOS drive circuitry, the heating member defining a resistive heating circuit and being of a material selected from a group of materials having a coefficient of thermal expansion which is such that, upon heating and subsequent cooling, the heating member is capable of expansion and contraction to an extent sufficient to perform work, the thermal bend actuator also including a support member of a material having a coefficient of thermal expansion that is less than that of the heating member, the heating member being fast with the support member and positioned on the support member intermediate the support member and the substrate so that, when the heating member expands upon heating, the support member, together with the heating member, bends away from the substrate, causing the ink ejection member to be displaced towards the ink ejection port so that ink interposed between the ink ejection port and the free end portion of the ink ejection member is ejected from the ink ejection port and upon subsequent cooling of the heating member, the ink ejection member is displaced away from the ink ejection port so that separation of ink and the formation of an ink drop occurs as a result of a consequent drop in ink pressure within the nozzle chamber between the free end portion of the ink ejection member and the ink ejection port.

11. A printhead chip as claimed in claim 10, in which the support member of the thermal actuator is of a material having a Young's Modulus that is selected so that displacement of the ink ejection member away from the ink ejection port is assisted by a release of tension that is set up in the support member during movement of the support member away from the support substrate.

12. A printhead chip for an ink jet printhead, the printhead chip comprising an elongate substrate; and a plurality of nozzle arrangements that are positioned along a length of the substrate, the substrate defining a plurality of ink inlet channels, each ink inlet channel being in fluid communication with a respective nozzle arrangement, each nozzle arrangement comprising a nozzle chamber structure that at least partially defines a nozzle chamber, the nozzle chamber structure having a roof that defines an ink ejection port, the nozzle chamber structure being configured so that the nozzle chamber is generally elongate and has a distal end and an opposed proximal end, the ink inlet channel of the nozzle arrangement being positioned adjacent the proximal end and the ink ejection port being positioned adjacent the distal end;

an actuator that is mounted on the substrate, the actuator being electrically connected to drive circuitry positioned on the substrate to drive the actuator and the actuator being connected to the nozzle chamber structure at the proximal end of the nozzle chamber so that the actuator can displace the nozzle chamber structure towards and a way from the substrate; and a static member that is mounted on the substrate intermediate the ink ejection port and the substrate so that displacement of the structure towards and away from the substrate results in the ejection of a drop of ink from the ink ejection port, the structure being dimensioned so that a fluid flow path defined between the ink ejection port and the ink inlet channel is configured to retard a flow of ink from the ink ejection port to the ink inlet channel when the structure is displaced towards the substrate.

13. A printhead chip as claimed in claim 12, which is the product of an integrated circuit fabrication technique.

14. A printhead chip as claimed in claim 13, in which CMOS drive circuitry is arranged on the substrate, each actuator being connected to the CMOS drive circuitry.

15. A printhead chip as claimed in claim 12, in which the nozzle chamber structure includes a pair of opposed sidewalls, a proximal end wall and a distal end wall that all depend from the roof, the walls and the roof being configured so that the nozzle chamber has a substantially rectangular plan profile.

16. A printhead chip as claimed in claim 15, in which a length of the nozzle chamber is at least approximately three times a depth of the nozzle chamber.

17. A printhead chip as claimed in claim 16, in which a length of the nozzle chamber is between approximately four times and ten times a depth of the nozzle chamber.

18. A printhead chip as claimed in claim 15, in which the static member is generally planar with a profile that corresponds generally with that of the nozzle chamber, the static member having a distal end portion that is positioned adjacent the ink ejection port and a proximal end portion that is positioned adjacent the ink inlet channel.

19. A printhead chip as claimed in claim 18, in which the actuator is in the form of a thermal bend actuator having a fixed end that is fast with an anchor formation positioned on the substrate and a movable end that is attached to said proximal end wall, the thermal actuator being connected to the CMOS drive circuitry.

20. A printhead chip as claimed in claim 19, in which the thermal bend actuator includes an electrically conductive heating member that is connected to the CMOS drive circuitry, the heating member defining a resistive heating circuit and being of a material selected from a group of materials having a coefficient of thermal expansion which is such that, upon heating and subsequent cooling, the heating member is capable of expansion and contraction to an extent sufficient to perform work, the thermal bend actuator also including a support member of a material having a coefficient of thermal expansion that is less than that of the heating member, the heating member being fast with the support member, the support member being positioned intermediate the heating member and the substrate so that, when the heating member expands upon heating, the support member, together with the heating member, bends towards the substrate, causing the nozzle chamber structure to be displaced towards the substrate so that ink interposed between the distal end portion of the static member and the ink ejection port is ejected from the ink ejection port and upon subsequent cooling of the heating member, the nozzle chamber structure is displaced away from the substrate so that separation of ink and the formation of an ink drop can occur as a result of a consequent drop in ink pressure within the nozzle chamber between the distal end portion of the static member and the ink ejection port.

21. A printhead chip as claimed in claim 20, in which the support member of the thermal actuator is of a material having a Young's Modulus that is selected so that displacement of the nozzle chamber structure away from the substrate is assisted by a release of tension that is set up in the support member during movement of the nozzle chamber structure towards the substrate.

22. A printhead chip as claimed in claim 19, in which the thermal bend actuator includes an electrically conductive heating member that is connected to the CMOS drive circuitry, the heating member defining an active portion and a passive portion, with the active portion defining a resistive heating circuit and the heating member being of a material selected from a group of materials having a coefficient of thermal expansion which is such that, upon heating and subsequent cooling, the active portion is capable of expansion and subsequent contraction to an extent sufficient to perform work, the active and passive portions being configured so that, when the active portion expands upon heating, the heating member bends towards the substrate, causing the nozzle chamber structure to be displaced towards the substrate so that ink interposed between the distal end portion of the static member and the ink ejection port is ejected from the ink ejection port and upon subsequent cooling of the heating member, the nozzle chamber structure is displaced away from the substrate so that separation of ink and the formation of an ink drop can occur as a result of a consequent drop in ink pressure within the nozzle chamber between the distal end portion of the static member and the ink ejection port.

* * * * *